United States Patent [19]

Merriman

[11] Patent Number: 5,029,943

[45] Date of Patent: Jul. 9, 1991

[54] APPARATUS FOR TRANSMITTING DATA

[75] Inventor: Colin G. M. Merriman, Preston, England

[73] Assignee: Gullick Dobson Limited, Lancashire, England

[21] Appl. No.: 524,725

[22] Filed: May 17, 1990

[51] Int. Cl.[5] ..... E21D 23/14

[52] U.S. Cl. ..... 299/1; 405/302

[58] Field of Search ..... 299/1, 11, 30, 33; 405/302

[56] References Cited

U.S. PATENT DOCUMENTS

| | | | |
|---|---|---|---|
| 4,146,271 | 3/1979 | Ward et al. | 299/1 |
| 4,330,154 | 5/1982 | Harris | 299/1 |
| 4,870,697 | 9/1989 | Weber | 299/30 X |

FOREIGN PATENT DOCUMENTS

| | | | |
|---|---|---|---|
| 372837 | 5/1973 | U.S.S.R. | 299/1 |

*Primary Examiner*—Ramon S. Brits
*Assistant Examiner*—David J. Bagnell
*Attorney, Agent, or Firm*—Nixon & Vanderhye

[57] ABSTRACT

Apparatus for transmitting data relating to a mining machine in a longwall mining operation, comprising a data collection device mountable on a mining machine for collecting data relating to the machine, a data transmission device also mountable on the mining machine for transmitting the data in the form of a remote signal, and a plurality of receiving devices each mountable on one of a plurality of mine roof supports past which the machine is arranged to travel. The apparatus also includes a data conveying device for conveying the data away from the mine roof supports.

16 Claims, 3 Drawing Sheets

APPARATUS FOR TRANSMITTING DATA

BACKGROUND TO THE INVENTION

The invention relates to the transmission of data, and particularly to the transmission of data relating to longwall mining systems.

The longwall method of mining is well known, and involves the use of a mineral cutting machine which travels back and forth across a wall of mineral. The cutting machine is mounted on a conveyor extending along the length of the wall, and as the cutting machine removes mineral from the wall, the mineral is conveyed to the end of the wall by the conveyor.

During the mining sequence, the exposed mine roof is supported by a row of hydraulic mine roof supports, each support being connected to the conveyor by an advancing ram. Once a new web of mineral has been removed, the conveyor must be advanced to a new position adjacent the newly cut face, and the mine roof supports must then follow to a new position adjacent to the conveyor.

This movement is carried out in stages. The conveyor is sufficiently flexible to perform a snaking movement along its length, and once the mineral cutting machine has moved past a given section of conveyor by a distance which is not less than the length of the snaked portion, that section is pushed forward by extending the advancing rams of the associated supports. The supports, each of which comprises a base, a roof engaging canopy, and hydraulic support legs, can be selectively advanced sequentially by lowering a given support from the roof, retracting its advancing ram to pull the support close to the conveyor again, and then resetting the support to the roof.

As mining techniques are becoming more and more sophisticated, there is a greater requirement for the degree of control to be exercised over the movement of the mining machine, the conveyor, and the supports, and in turn there is a greater requirement to receive data from these components concerning the manner in which they are operating, their position with respect to one another, and other parameters.

BRIEF DESCRIPTION OF THE PRIOR ART

The mining machine is provided with power via a trailing cable and at present, if it is desired to collect data from the machine, it is necessary for this data to be transmitted along additional cores of the trailing cable. This requires the provision of expensive coding equipment on the machine, and expensive decoding equipment at the end of the mining wall. Furthermore, there can be problems with the reliability of the trailing cable, and there is also considerable electrical noise which can corrupt the data.

OBJECT OF THE INVENTION

It is the object of the invention to provide a way of transmitting data from a mining machine but without the above mentioned problems.

SUMMARY OF THE INVENTION

The invention provides a method of transmitting data from a mining machine to the end of the mine face of a longwall mining operation comprising the steps of collecting data concerning the machine, transmitting the data by remote signalling means to mine roof supports in the vicinity of the machine, and conveying the data from the mine roof supports to the end of the face.

The data may relate to the location and/or operation of the machine.

Relevant parameters which may be monitored include the following:

- speed and direction of the machine,
- load required to move the machine,
- cutting force,
- motor power consumption,
- oil levels, pressures and temperatures,
- angle of the boom carrying the cutting drum or drums.

Position may be calculated by noting which support is receiving data from the machine.

The invention includes apparatus for transmitting data from a mining machine to the end of the mine face of a longwall mining operation, the apparatus comprising data collection means mountable on a mining machine for collecting data relating to the machine, data transmission means also mountable on the mining machine, for transmitting the data in the form of remote signal, a plurality of receiving means each mountable on one of a plurality of mine roof supports past which the machine is to travel, each receiving means being capable of receiving the data, and data conveying means for conveying the data from the mine roof supports to the end of the mine face.

Preferably the remote signal is an infra red signal. It may however comprise some other signal, e.g. a radio signal, an inductive signal, a microwave signal or an optical signal.

The receiving means may be connected to, or form part of, control boxes for controlling the mine roof supports.

The data conveying means may comprise electric cables extending between the control boxes and the end of the mine face.

The electric cables may be used not only to convey the data but also to control the mine roof supports.

Other objects and advantages of the invention will become apparent from the following description of an embodiment of the invention, given by way of example, with reference to the accompanying drawings in which:

DESCRIPTION OF PREFERRED EMBODIMENT

Figure 1:
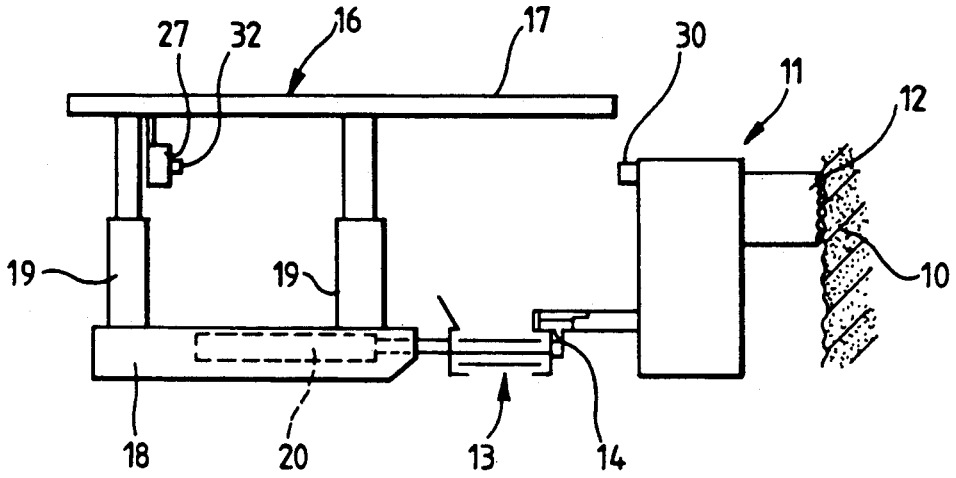
FIG. 1 is a side view showing a mine face, a mining machine, a mining conveyor and one hydraulic mine roof support, operating according to one embodiment of the invention.

In the longwall mining operation shown, mineral is progressively cut away from the face 10 by a mining machine 11 which traverses the face. At each end of the machine there is a cutting drum 12 and each time the machine makes a pass along the mineral face 10 it cuts away a web of mineral, as is perhaps best illustrated in FIG. 2.

The machine 11 is arranged to travel along an armoured face conveyor 13, by means of a guide rail 14.

Extending along the length of the conveyor 13 is a row 15 of mine roof supports. One mine roof support is shown in detail, in side view, in FIG. 1. This support, 16, has a roof engaging canopy 17, a floor engaging base 18, and a plurality of hydraulic support legs 19 extending between the base and the canopy. Each support has an advancing ram 20 which connects it to the conveyor.

Figure 2:
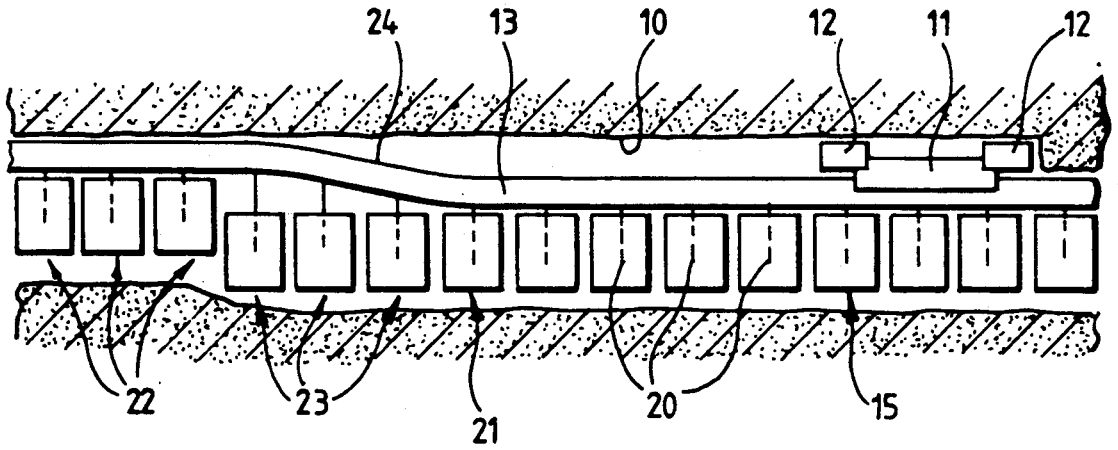
FIG. 2 is a plan view showing the entire longwall mining operation.

Looking at FIG. 2, the support 21 and all the supports to the right of it are in a first position, immediately adjacent to the conveyor 13, as the mining machine 11 moves past them, cutting the mineral away to be conveyed to the end of the mine face by the conveyor. The advancing rams 20 of these supports are all retracted, and the legs 19 are extended, keeping the canopy 17 in load bearing engagement with the mine roof.

Once one web of mineral has been cut away, the conveyor 13 has to be advanced to a new position, adjacent to the freshly cut face, and the mine roof supports have to follow, before a further cut can be made.

It will be seen from FIG. 2 that the conveyor is capable of making a snaking movement, and the left hand end of the conveyor has already been fully moved to its new position, and three of the mine roof supports, 22, have followed.

The conveyor is pushed forwardly by extending the rams 20 of selected supports, while the supports are still firmly wedged in position between the mine floor and mine roof. The three supports 23 are in this condition, and their rams 20 are in the process of pushing forward the snaked part 24 of the conveyor.

Once the support has pushed its associated section of conveyor forward, the support is freed from the roof by lowering its legs 19, and the support can then be pulled forwardly by retracting its ram 20. This is what has happened to the three supports 22 in FIG. 2, but of course they are not moved forwardly simultaneously. The supports are moved forwardly selectively, so that the mine roof is always supported.

The movement and control of all the supports, the conveyor 13, and the machine 11, is fairly complicated, and as the equipment becomes more sophisticated, it is becoming desirable to increase the degree of control over these items of equipment, and to increase the amount of information that is available about their position and mode of operation.

It is particularly useful to obtain information about the way in which the mining machine 11 is operating, and until now it has only been possible to obtain this information via the trailing cable which powers the machine. This cable is shown diagrammatically at 25 in FIG. 3 leading to a power supply source 26 at the end of the mine face. However, use of the cable presents difficulties. There is considerable electrical noise along the cable, and the cable itself is not always entirely reliable. Furthermore, complicated and expensive decoding and encoding equipment is necessary.

We have now realised that it is possible to make use of existing transmission links to provide more effective data transmission.

We have already developed an electrical control system for the supports which involves the use of electrical control boxes, one mounted on each support, and these control boxes are already electrically connected by cables to a control unit of the line face. Typical control boxes are illustrated at 27 in FIG. 3. The control boxes are electrically connected to each other, so that events on one support can be used to control an adjacent support.

Since these cables are already only used to carry low power data and control signals, they are not subject to the electrical noise which is associated with the trailing power cable 25 of the mining machine.

According to this embodiment, the mining machine 11 is provided with internal data collection means 31 (shown diagrammatically in FIG. 3, and in more detail in FIG. 4) which is connected to an infra red transmitter 30. The position of the transmitter 30 on the machine can be seen in FIG. 1, and it will be seen that the transmitter is substantially vertically aligned with a receiver 32 connected to one of the control boxes 27.

Figure 3:
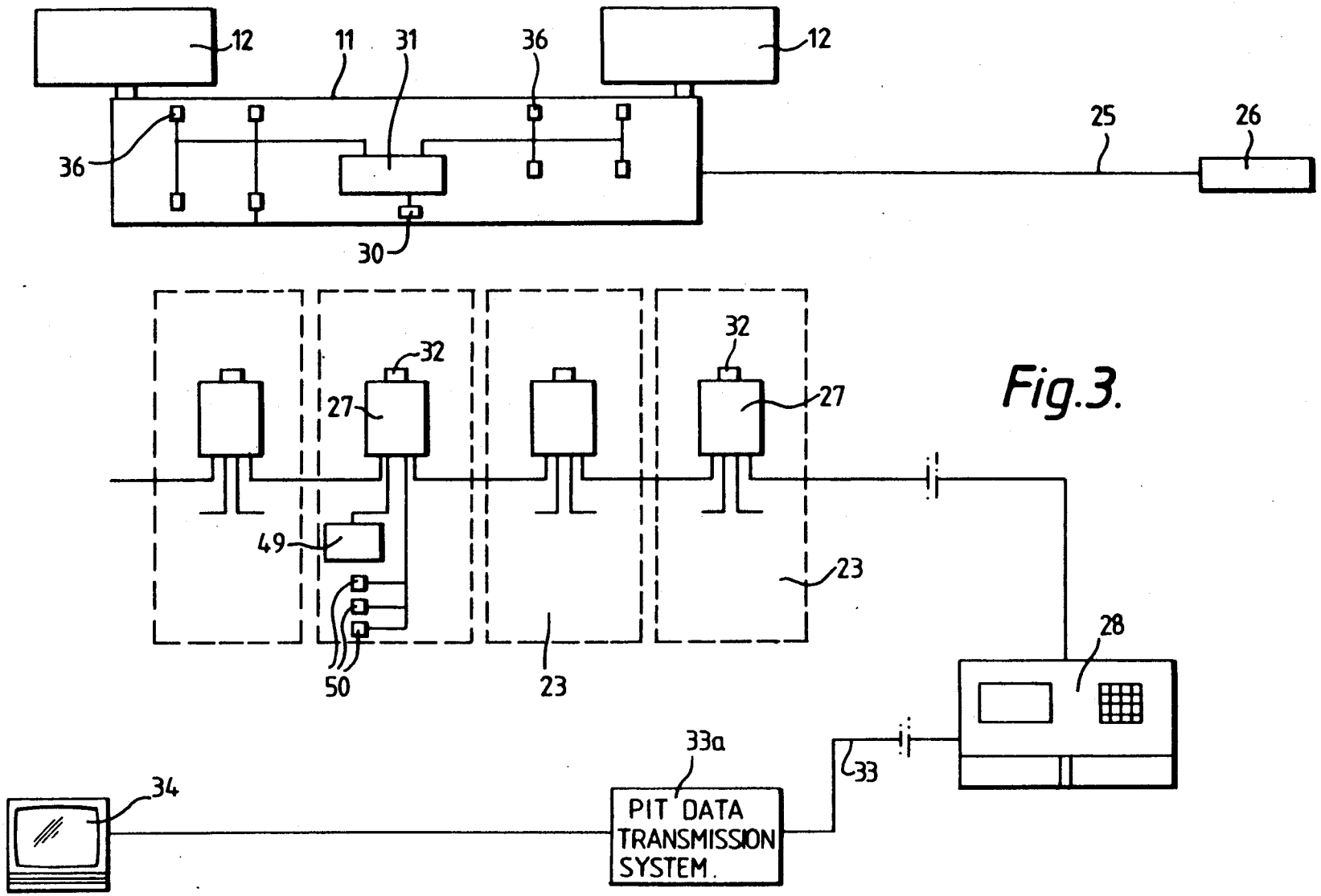
FIG. 3 is a diagrammatic view of electrical components according to the embodiment.

It will be seen from FIG. 3 that each control box 27 has its own receiver 32.

As the mining machine travels along the mine face, the collection means 31 is continually collecting information which monitors the machines performance. This information is transmitted in the form of an infra red signal from the transmitter 30, and is received by the nearest mine roof support, via its associated receiver 32. The data is then passed along the existing communication links to the face end control unit 28. If desired data may also be transmitted via a cable 33 to a remote point 34, for example at the mine surface. There may be a direct link, or communication may be through a pit data transmission system 33*a*.

The data transmission method and apparatus provided by this embodiment avoids the problems associated with electrical noise and the unreliability of a continually moving trailing cable, and it also avoids the need for expensive equipment, since much existing equipment can be used.

The collection means 31 and transmitter 30 will now be described in more detail, with particular reference to FIG. 4. It can be seen from FIG. 3 that the collection means 31 collects data from a plurality of transducers 36, positioned at various points on the cutting machine.

Figure 4:
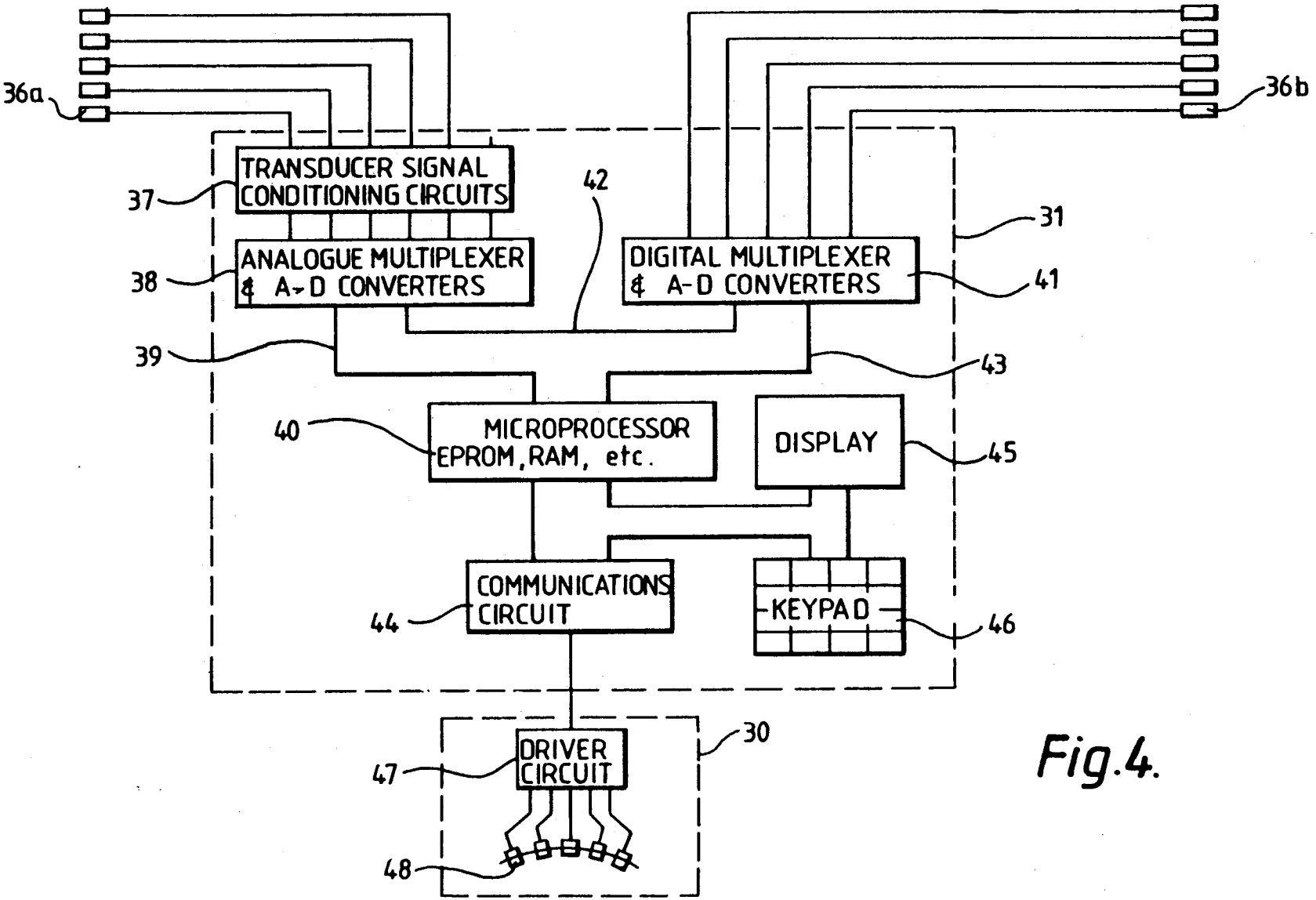
FIG. 4 is a more detailed view of the components shown in FIG. 3 which are, in use, mounted on the mineral cutting machine.

As can be seen from FIG. 4, there are two separate groups of transducers, 36*a* and 36*b*.

The transducers 36*a* are analogue transducers, monitoring various varying parameters, for example speed, and signals from these analogue transducers pass through transducer signal conditioning circuits 37 and then to an analogue multiplexor 38 provided with analogue to digital converters. Information can be passed from the multiplexor 38, via a line 39, to processing circuitry 40, for example including a microprocessor, EPROM RAM, etc.

The transducers 36*b* monitor digital functions, such as on/off states. Digital signals from these transducers pass through a digitial multiplexor 41, also provided with analogue to digital converters, so that the multiplexor can communicate with the analogue multiplexor 38, via a line 42. The digital multiplexor 41 also communicates with the processing circuitry 40, via a line 43. Processed information from the circuitry 40 passes to a communications circuit 44 and thence to the transmitter 30. Information from the processing circuitry 30 also passes to a visual display unit 45 and a key-pad 46 is connected between the communications circuit 44 and the display 45, for use in programming the processing circuitry 40.

Again as best seen in FIG. 4, a transmitter 30 comprises a driver circuit 47 which is connected to a plurality of infra-red transmitter diodes 48 for the purpose of producing various signals to convey the data.

The signals are allocated a special code in the transmitter 30, so that the receivers 32 only react to signals having the appropriate code. This ensures that the receivers 32 do not accidentally react to stray infra-red radiation, such as might be received from underground luminaires or miners cap lamps.

The system also makes it possible to monitor the position of the mining machine in relation to the supports, by noting which of the receivers 32 is currently accepting the data. The horizontal beam width produced by the transmitter 30 is deliberately restricted to reduce any uncertainty as to the position of the machine. At present it is possible to reduce the uncertainty so that it is never more than that of one support. This is obviously useful in the situation shown in FIG. 2, where it is important that the mine roof supports do not start to move the conveyor forwardly, until the mining machine has travelled well clear of that part of the conveyor which is to be moved.

The control boxes 27 may also be used to convey control and monitoring information relating to the supports themselves, and FIG. 3 shows one of the boxes 27 connected to roof support control valve gear 49 and roof support control and/or monitoring transducers 50.

In an alternative arrangement, the boxes 27 may each be directly connected to a common line which leads directly to the face end control unit 28.

The apparatus may be arranged to provide continuous transmission of data from the mining machine to the mine roof supports, or there may be signal responsive transmissions. For example, the mining machine may only transmit data when the data collection means and/or data transmission means on the mining machine receives a coded initiation signal from appropriate means mounted on one or more of the mine roof supports.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. Apparatus for transmitting data relating to a mining machine in a longwall mining operation, said apparatus comprising:

data collection means mountable on a mining machine for collecting data relating to the machine;

data transmission means also mountable on the mining machine for transmitting the data in the form of a remote signal;

a plurality of data receiving means for receiving the data, each said receiving means being mountable on one of a plurality of mine roof supports past which the machine is arranged to travel; and data conveying means for conveying the data away from said mine roof supports.

2. Apparatus according to claim 1, in which said data conveying means conveys the data to an end of the mine face.

3. Apparatus according to claim 1, wherein said remote signal is an infra-red signal.

4. Apparatus according to claim 1, wherein said remote signal is selected from a radio signal, an inductive signal, a microwave signal, and an optical signal.

5. Apparatus according to claim 1, in which said data receiving means is connected to control boxes for controlling the mine roof supports.

6. Apparatus according to claim 5, in which said data conveying means comprises electric cables extending between the control boxes and an end of the mine face.

7. Apparatus according to claim 6, in which said electric cables may be used for conveying the data and for controlling the mine roof supports.

8. Apparatus according to claim 1, wherein said data receiving means is activated in response to a transmitted coded signal.

9. Apparatus according to claim 8, wherein said data receiving means is intermittently addressed by a transmitted coded signal.

10. Apparatus according to claim 1, wherein said data collected and transmitted includes multiplexed digital signals.

11. Apparatus according to claim 1, in which said data collected and transmitted relates to the location and operation of the machine.

12. Apparatus according to claim 1, in which machine parameters which are monitored are selected from speed and direction of the machine, load required to move the machine, cutting force, motor power consumption, oil levels, pressures and temperatures, and angle of a boom carrying a cutting drum.

13. Apparatus according to claim 1, in which position of the mining machine is calculated using data received by said receiving means from the machine.

14. Apparatus according to claim 1, in which said transmission means addresses at least one of said receiving means mounted on one of a plurality of mine roof supports, such that the receiving means nearest to the transmission means is addressed by a signal transmitted from said transmission means to enable the position of the addressed receiving means to be determined.

15. Apparatus according to claim 14, in which said data transmission means is mounted such that said signal is transmitted in a substantially directional beam, aimed in the general direction of a receiving means.

16. Apparatus according to claim 15, in which said data transmission means is mounted such that said directional beam scans a plurality of said receiving means upon movement of the mining machine along the mine face.

* * * * *